US007084349B1

(12) United States Patent
Bates et al.

(10) Patent No.: US 7,084,349 B1
(45) Date of Patent: Aug. 1, 2006

(54) INSULATED POWER CABLE

(75) Inventors: Lisa C. Bates, Chester, VA (US); Richard P. Marek, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 11/050,504

(22) Filed: Feb. 3, 2005

(51) Int. Cl.
*H01B 7/288* (2006.01)

(52) U.S. Cl. ..... 174/121 R; 174/26 R; 174/113 R; 174/122 R; 174/124 R; 174/128.2

(58) Field of Classification Search ..... 174/113 R, 174/26 R, 121 R, 122 R, 124 R, 128.2
See application file for complete search history.

(56) References Cited

U.S. PATENT DOCUMENTS

| | | | | |
|---|---|---|---|---|
| 2,607,822 A | * | 8/1952 | Crandall | 174/18 |
| 2,624,245 A | | 1/1953 | Cluett | |
| 2,798,899 A | * | 7/1957 | Crandall | 174/121 R |
| 3,260,778 A | | 7/1966 | Walton | |
| 3,426,405 A | | 2/1969 | Walton | |
| 3,756,908 A | | 9/1973 | Gross | |
| 4,090,385 A | | 5/1978 | Packard | |
| 5,026,456 A | | 6/1991 | Hesler et al. | |

FOREIGN PATENT DOCUMENTS

| | | |
|---|---|---|
| WO | WO 2001 91135 A1 | 11/2001 |
| WO | WO 2002/076723 A1 | 10/2002 |

OTHER PUBLICATIONS

Research Disclosure RD10833, Apr. 1973, Creped and Calendered Nomex Paper Insulation (H01, B31).
Research Disclosure RD10947, May 1973, Patterned Low Density Nomex Nylon Paper (B31, H01).

* cited by examiner

*Primary Examiner*—Jinhee Lee

(57) ABSTRACT

This invention relates to a transformer containing an insulated power cable including a multi-strand cable of a plurality of bundles of uninsulated wires, and electrical insulation sheathing the cable, the electrical insulation having a thickness of from 0.0625 to 0.5 inches (0.16 to 1.3 centimeters) and containing a plurality of layers of spirally-wrapped, creped tape, the tape being including at least 50 percent by weight of an aramid material, the tape having a density of from 0.1 to 0.5 grams per cubic centimeter prior to being creped.

11 Claims, 1 Drawing Sheet

INSULATED POWER CABLE

BACKGROUND OF THE INVENTION

1. Field of the Invention

This invention relates to insulated power cables, particularly insulated cables commonly used in fluid-filled electrical transformers.

2. Description of Related Art

Insulated cables and insulated winding wires are both used in fluid-filled transformers. Insulated winding wire is used to form the winding of the transformer. This winding wire needs to be sufficiently stiff in order to withstand mechanical stresses that occur during operation of the transformer. Insulated cable connects various components within the transformer such as winding taps to no-load or on-load tap changers, phase interconnections, and internal windings to bushing connectors. In contrast to insulated winding wire, insulated cable needs to be sufficiently flexible to allow easy maneuverability to the connection points. The cable is then supported mechanically when additional strength is required.

The conductor of the windings in a transformer is typically composed of a number of winding wires individually insulated to prevent one wire from coming in contact with another. In many cases these insulated winding wires are rectangular in cross section to ensure a dense uniform packing of the transformer windings. In contrast, the insulated cables used in transformers are normally made from a plurality of bundles of uninsulated wires and are generally circular in cross section. Since these cables transmit electricity at high voltages and high amperages, the key requirement is that they have sufficient insulation to prevent dielectric breakdown from one cable to the next, which could be catastrophic in an oil-filled transformer. Cables in an oil-filled transformer have traditionally been insulated with spiral-wound, creped cellulosic paper tapes, and the size and number of cables used in a transformer were determined by first specifying the desired maximum temperature difference between the wire cable and the transformer oil while under load, and then using enough cables to handle the desired current without exceeding the required maximum temperature difference. For cellulosic paper tapes, the maximum temperature difference was generally about 20 degrees Celsius (Transformer Engineering, Second Ed., published by John Wiley and Sons, Page 321), because any higher temperature difference could cause premature aging of the cellulosic insulation and eventual cable failure. However, if the cables could be operated at higher temperature, that is, if the maximum temperature difference could be increased to around 60 degrees Celsius, the size of the cables and/or the number of cables needed for the transformer could be reduced. Therefore, what is needed is a cable that can withstand a higher temperature without premature aging of the insulation.

Research Disclosure RD10833, April 1973 discloses wire conductors can be wrapped using a "longitudinal-wrapping" technique wherein a narrow tape of Nomex® is applied parallel to the wire, folded around the wire, and sealed. It is preferred to use a tape that had been creped and then lightly calendered to maintain a desirable thickness for the insulation.

Research Disclosure RD10947, May 1973 discloses that in certain applications where high porosity is desired, such as insulation for oil-filled transformers, a special low density paper, e.g. Nomex® 411 is particularly preferred.

WO200191135 to Rolling et al. discloses an electrical apparatus that includes one conductor and an insulation paper surrounding at least part of the conductor; the insulation paper includes a wood pulp fiber, a synthetic fiber which can be an aramid fiber, and a binder material, with the synthetic fiber being present at between 2 and 25 weight percent. The insulation paper can be creped and spirally wrapped around the conductor.

BRIEF SUMMARY OF THE INVENTION

This invention relates to an insulated power cable comprising a multi-strand cable of a plurality of uninsulated wires, and electrical insulation sheathing the cable, the electrical insulation having a thickness of from 0.0625 to 0.5 inches (0.16 to 1.3 centimeters) and comprising a plurality of layers of spirally-wrapped, creped tapes, the tapes being comprised of at least 50 percent by weight of an aramid material that has a density of from 0.1 to 0.5 grams per cubic centimeter prior to being creped.

DETAILED DESCRIPTION OF THE INVENTION

Figure 1:
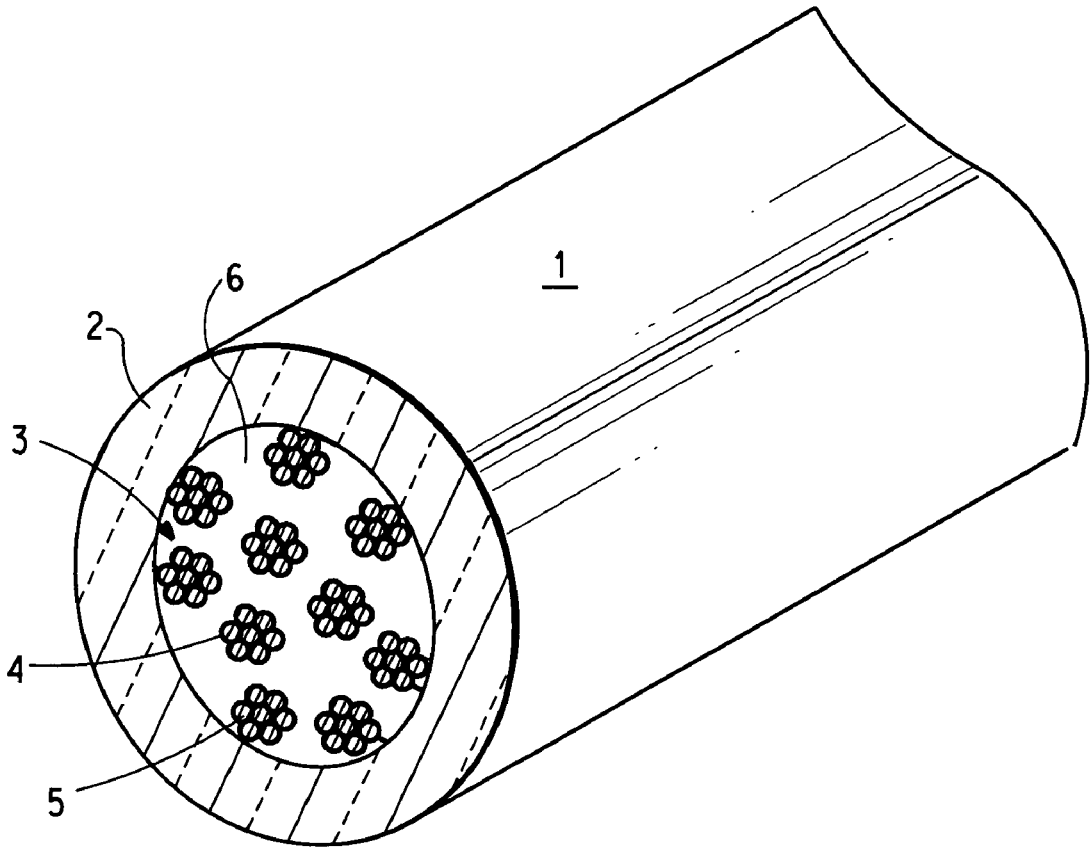
FIG. 1 is a representative of one embodiment of a cable of this invention.

This invention relates to an insulated power cable, particularly insulated cables commonly used in fluid-filled electrical transformers. The insulated cables of this invention include a multi-strand cable comprising a plurality of bundles of uninsulated wires, and electrical insulation sheathing the cable. One embodiment of the cable of this invention is shown in the FIGURE. Insulated cable 1 is shown with a layer of insulation 2 sheathed over a multi-strand cable 3. Multi-strand cable 3 is comprised of a plurality of uninsulated wires 4 that are preferably in a plurality of bundles 5. For clarity, the insulated cable shown in the FIGURE has an exaggerated amount of open space 6 between the bundles, however, preferably and generally in practice there is very limited open space between the bundles.

The electrical insulation 2 that sheathes the multi-strand cable 3 has a radial thickness of from 0.0625 to 0.5 inches (0.16 to 1.3 centimeters). An insulation thickness of less than about 0.0625 inches is believed to provide too little amount of insulation material to provide sufficient dielectric strength. A thickness of more than about 0.5 inches is believed to provide a cable that does not permit a reasonable bending radius. The thickness of the insulation is made up of multiple layers of aramid material, and the overall density of the sheath of electrical insulation on the cable is from about 0.2 to 0.6 grams per cubic centimeter, preferably about 0.3 to 0.5 grams per cubic centimeter. Since the radial thickness or "build" of the insulation is the critical parameter, the actual number of layers of materials can vary, with 10 to 100 layers or more layers being possible. The layers of aramid material are preferably narrow tapes having a width of approximately 0.25 to 2 inches. The tapes preferably have random ridges and grooves, or crepes, across the width of the tape. The ridges and grooves are imparted into the tape by any available means, but creping methods that impart a series of random ridges and grooves are preferred, and micro-creping or dry-creping methods and equipment such as disclosed in International Patent Application WO2002/

076723 to Walton et al.; U.S. Pat. No. 3,260,778 to Walton; U.S. Pat. No. 2,624,245 to Cluett; U.S. Pat. No. 3,426,405 to Walton; and U.S. Pat. No. 4,090,385 to Packard are preferred. Equipment for micro-creping sheets and tapes can be obtained from Micrex Corporation of Walpole, Mass. 02081. Such equipment, in general, presses the tape to be creped against a driven roll that advances the tape towards a retarding element such as a retarding blade, the tip of which is held adjacent to the driven roll. The retarding element causes the tape to be coarsely folded upon itself by repeated columnar collapse of the tape to form the preferred ridges and grooves. The tape is preferably mechanically linearly compacted during the microcreping process about 10 to 200 percent, preferably 25 to 150 percent, based on the weight increase of the tape per unit area.

It is critical that the oil that is used in transformers be able to penetrate and saturate the insulation around the multi-strand cable. Therefore, the insulation is applied by spirally-wrapping the tapes around the cable to form layers that allow routes for the oil to penetrate and be present between the layers of the insulation. As used herein, "spirally-wrapped" is meant to include spiral or helical wrapping of one or more tapes around the outer circumference of the cable. More importantly, the aramid material used in the tapes must have a density, prior to creping, of about 0.1 to 0.5 grams per cubic centimeter, which provides an insulation having enough porosity to allow the oil to fully saturate the tape material after it has been wrapped on the multi-strand cable. Creping of the tapes provides the tapes with some extensibility so that it can be tightly wrapped around the cable while at the same time eliminate any stiffness that might be imparted to the cable from use of a stiff tape. In certain embodiments of this invention the tapes are made from "formed" paper that has been made on a wire and lightly compressed but not substantially densified by the additional application of high heat and pressure, by for example, a set of heated calender rolls. This aramid material can be any nonwoven sheet material comprising aramid fibers that can be slit into tapes, and can be various types of spunbonded, spunlaced, or paper-like sheets or laminated structures. In a preferred embodiment, the nonwoven sheet material is an aramid paper. As employed herein the term paper is employed in its normal meaning and it can be prepared using conventional paper-making processes and equipment and processes. The thickness of the aramid nonwoven sheet or paper (prior to creping) is not critical but typically ranges from about 0.002 to 0.015 inches.

The preferred aramid papers used in this invention are typically made by forming a slurry of aramid fibrous material such as fibrids and short fibers which is then converted into paper such as on a Fourdrinier machine or by hand on a handsheet mold containing a forming screen. Reference may be made to Gross U.S. Pat. No. 3,756,908 and Hesler et al. U.S. Pat. No. 5,026,456 for processes of forming aramid fibers into papers.

As employed herein the term aramid means polyamide wherein at least 85% of the amide (—CONH—) linkages are attached directly to two aromatic rings. Additives can be used with the aramid and, up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. In the practice of this invention, the aramids most often used are: poly(paraphenylene terephthalamide) and poly(metaphenylene isophthalamide) with poly(metaphenylene isophthalamide) being the preferred aramid.

The insulation material is comprised of at least 50 percent by weight of an aramid material. Other materials that can be used include celluose, polyamide, polyimide, liquid crystal polymer, polyethylene naphthalate, polyphenylene sulfide, polybenzoxazole, polybenzimidazole, polyetherimide, polyethersulfone, wholly aromatic copolyamides such as those sold under the trademark Technora®, fluorinated hydrocarbons, or any combination thereof. Preferably these other materials are in the form of fibers or particles in the paper. Insulation material having less than this amount of aramid material is not desired because generally it cannot withstand greater than 130 degrees Celsius operating temperature. Preferably the insulation material comprises 75 to 100% aramid materials to take advantage of the high temperature performance of the aramid polymer.

The multi-strand cable 3 shown in the FIGURE that is covered by the insulation is formed from a plurality of uninsulated wires 4 that are preferably present in the form of a plurality of bundles 5. The multi-strand cable in certain embodiments of this invention has an overall size of from 8 AWG to 1000 MCM, preferably of a size of 1/0 to 750 MCM. The multi-strand cable preferably meets at least one of ASTM standards ASTM B172, ASTM B173 or ASTM B8 for stranded copper conductors. Such multi-strand cables are available from Rea Magnet Wire Company, Inc., of Osceola, Ark. and Southwire Company of Carrollton, Ga. Two cables of the present invention were made from a 500 MCM multi-strand cable having 427 copper wires, each cable having a nominal diameter of 0.924 inches, which was sheathed by 15 or 36 layers of creped Type 411 aramid paper tapes. Type 411 aramid paper is an undenisified, 100% percent poly (metaphenylene isophthalamide) paper having a density of 0.31 grams per cubic centimeter prior to creping. The 15-layer cable utilized 13 tapes having a width of 1.25 inches (3.175 centimeters), while the 36-layer cable utilized 32 tapes having a width of 1.3125 inches (3.334 centimeters). Each layer of the aramid paper tape had a thickness of 0.00834 inches (0.02 centimeters) prior to creping and a thickness of 0.0255 inches (0.0648 centimeters) after creping. The tapes were spirally wrapped around the multi-strand cable and the final insulative sheathing had a thickness, or build, on the 15-layer multi-strand cable of 0.125 inches (0.32 centimeters) and a thickness or build on the 36-layer multi-strand cable of 0.25 inches (0.64 centimeters). The cable was immersed in mineral oil, which fully penetrated the sheathed insulation.

A key benefit of the cable of this invention is that it can be operated at a higher temperature in the transformer than prior art cables. The maximum temperature difference between the oil in the transformer and the cable can be increased to around 60 degrees Celsius, thereby reducing the number of cables needed for the transformer without premature aging of the insulation. For example, a 50 MVA, 12470V transformer utilizing three 350 MCM cables with 0.125 inches build of cellulosic insulation would need to operate with only two of the same cable size insulated with 0.125 inches build of creped aramid sheet as described by this invention.

In one embodiment, the cable of this invention is useful as a cable in a transformer. Another embodiment of this invention is a transformer comprising the insulative multi-strand cable as described herein.

What is claimed is:

1. A transformer containing an insulated power cable comprising:

a) a multi-strand cable comprising a plurality of uninsulated wires, and b) electrical insulation sheathing the cable, the electrical insulation having a thickness of from 0.0625 to 0.5 inches (0.16 to 1.3 centimeters) and comprising a plurality of layers of spirally-wrapped, creped tape, the tape being comprised of at least 50 percent by weight of an aramid material, the tape having a density of from 0.1 to 0.5 grams per cubic centimeter prior to being creped;

wherein the transformer employs oil as insulation and in use of the transformer a temperature difference of 60 degrees C. can be maintained between oil in the transformer and conductor in the cable.

2. The transformer of claim 1 wherein the density of the electrical insulation sheathed on the cable is from 0.2 to 0.6 grams per cubic centimeter.

3. The transformer of claim 2 wherein the density of the electrical insulation sheathed on the cable is from 0.3 to 0.5 grams per cubic centimeter.

4. The transformer of claim 1 wherein the aramid material is a nonwoven sheet comprising aramid fibers.

5. The transformer of claim 4 wherein the nonwoven sheet is an aramid paper.

6. The transformer of claim 1 wherein the aramid material is a meta-aramid polymer.

7. The transformer of claim 6 wherein the meta-aramid polymer is poly(metaphenylene isophthalamide).

8. The transformer of claim 1 wherein the aramid material is a para-aramid polymer.

9. The transformer of claim 8 wherein the para-aramid polymer is poly(paraphenylene terephthalamide).

10. The transformer of claim 1 wherein the plurality of uninsulated wires are present in the form of a plurality of bundles.

11. The transformer of claim 1 wherein the multi-strand cable has a size from 8 AWG to 1000 MCM.

* * * * *